United States Patent [19]

Fujiwara

[11] Patent Number: 4,676,057

[45] Date of Patent: Jun. 30, 1987

[54] SPINNING MACHINE

[75] Inventor: Michiaki, Fujiwara, Kameoka, Japan

[73] Assignee: Murata Kikai Kabushiki Kaisha, Kyoto, Japan

[21] Appl. No.: 824,787

[22] Filed: Jan. 31, 1986

[30] Foreign Application Priority Data

Feb. 6, 1985 [JP] Japan ..... 60-14667[U]

[51] Int. Cl.[4] ..... D01H 13/22

[52] U.S. Cl. ..... 57/265; 57/264

[58] Field of Search ..... 57/22, 263, 264, 265

[56] References Cited

U.S. PATENT DOCUMENTS

| | | | |
|---|---|---|---|
| 3,751,893 | 8/1973 | Goodhue et al. | 57/265 |
| 3,899,868 | 8/1975 | Lee et al. | 57/265 X |
| 3,908,347 | 9/1975 | Vignon | 57/264 |
| 4,056,926 | 11/1977 | Stuber | 57/264 X |
| 4,060,965 | 12/1977 | Schwartz | 57/265 |
| 4,136,511 | 1/1979 | Raasch | 57/265 |
| 4,137,699 | 2/1979 | Stahlecker et al. | 57/264 |
| 4,178,749 | 12/1979 | Stahlecker et al. | 57/263 |

*Primary Examiner*—Donald Watkins

*Attorney, Agent, or Firm*—Barnes, Kisselle, Raisch, Choate, Whittemore & Hulbert

[57] ABSTRACT

A spinning machine including a plurality of spinning units having a yarn detecting device, respectively, and a knotting truck disposed to be movable along the spinning units further provides detecting device for detecting the yarn joining operation of the knotting truck, an arithmetic part for counting the times of the yarn joining operation and device for indicating the percentage of successful joining.

4 Claims, 6 Drawing Figures

SPINNING MACHINE

FIELD OF THE INVENTION AND RELATED ART STATEMENT

The present invention relates to a spinning machine, and more particularly to a spinning machine such that a yarn joining operation in a plurality of spinning units is performed by a single knotting truck, where the percentage of successful joining is indicated.

There has been known a spinning machine comprising a plurality of spinning units disposed adjacent to each other and a knotting truck disposed to be movable along the spinning units, such that the knotting truck is stopped at the position of the spinning unit in which yarn breakage has occurred, to automatically perform the yarn joining. For example, it is disclosed in U.S. Pat. No. 4,419,861.

However, the knotting truck in such a spinning machine has the problem that when a trouble is present in a part of the joining mechanism, a joining operation is not always successful, so that movement of the truck and the joining operation are repeated in the condition where joining cannot be accomplished, resulting in a marked reduction in the operating efficiency of the spinning machine. In particular, in a spinning mill with a plurality of spinning machines installed therein, it is difficult to find a defective knotting truck.

OBJECT AND SUMMARY OF THE INVENTION

It is an object of the present invention to provide a spinning machine high in operating efficiency in which the operating condition of a knotting truck can be easily grasped.

To attain the abovementioned object, the present device provides a spinning machine comprising a plurality of spinning units disposed adjacent to each other and having yarn-detecting means in respective yarn spinning and transferring passages, and a knotting truck disposed to be movable along the spinning units so as to detect the spinning unit in which yarn breakage has occurred on the basis of a yarn absent signal from the yarn-detecting means and to perform yarn joining, wherein the knotting truck is provided with means for detecting the joining operation thereof, the number of times of joining operations and the number of times of successful joining are counted by an arithmetic part based on detection signals from the joining operation detecting means and yarn present signals from the yarn-detecting means, then the percentage of successful joining is calculated from the counted values and is indicated by means for indicating the percentage of successful joining.

DETAILED DESCRIPTION OF PREFERRED EMBODIMENTS

A working example of the present invention will now be detailed below, based on the attached drawings.

Figure 1:
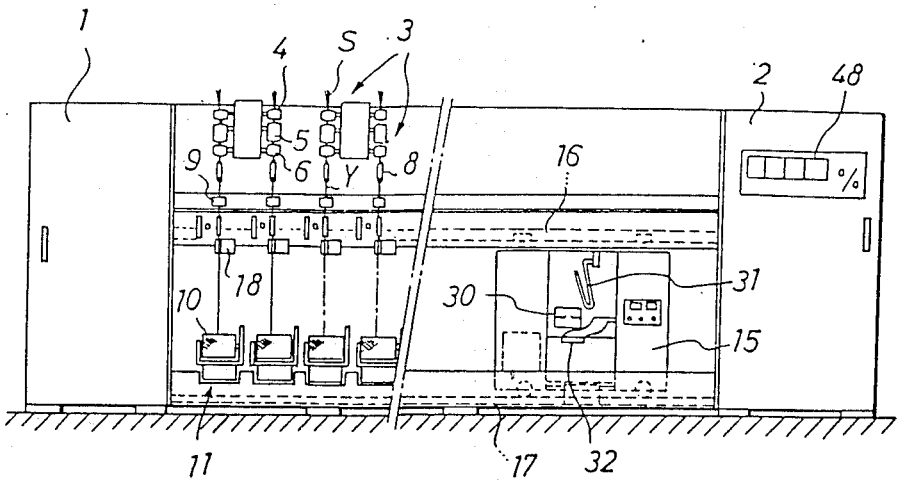
FIG. 1 is a front view of a working example of the spinning machine according to the present device.

As shown in FIG. 1, between a motor box 1 and a blower box 2 are provided a plurality of spinning units 3 adjacent to each other.

Figure 2:
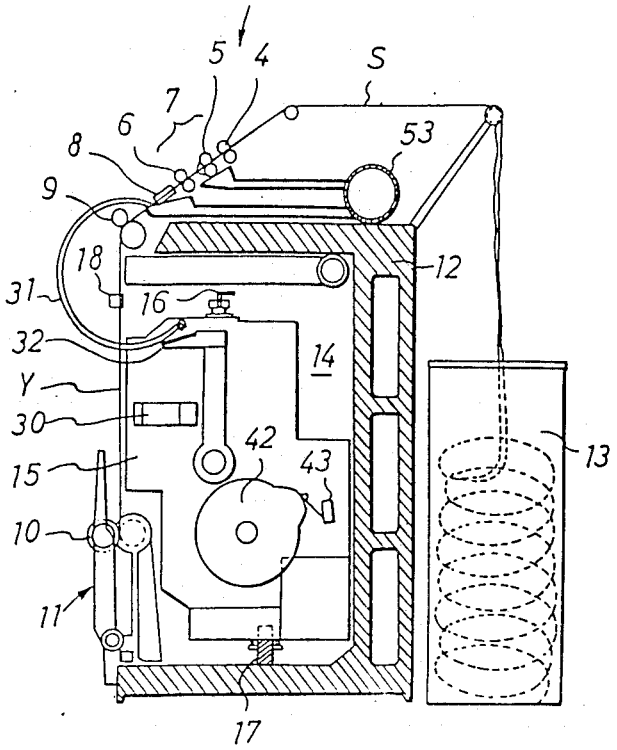
FIG. 2 is a schematic side sectional view of the same example.

The spinning unit 3 is the so-called pneumatic spinning unit which, as shown in FIG. 2, is constituted mainly of a draft part 7 consisting of back rollers 4, middle rollers 5 and front rollers 6; an air jet nozzle 8 for swirling a sliver S supplied from the front rollers 6 of the draft part 7, by a swirl air flow to form a spun yarn Y; nip rollers 9 for drawing out the spun yarn Y formed through the nozzles 8; and a take-up part 11 for taking up the spun yarn Y fed out from the nip rollers 9 into a package 10 while traversing the yarn Y. The spinning unit 3 is disposed on a frame body 12 having a roughly U-shaped side cross section so that the nip rollers 9 are located in the vicinity of a front end part of an upper part of the frame body 12 and the take-up part 11 is located in the vicinity of a front end part of a lower part of the frame body 12. At a back part of the frame body 12 is provided a sliver can 13 which contains the sliver S to be supplied to the back rollers 4 of the draft part 7.

In addition, in an internal space 14 of the frame body 12 is contained a knotting truck 15 which will be described later, so that it can be moved leftward and rightward in FIG. 1 along upper and lower rails 16 and 17. Incidentally, numeral 53 denotes a discharge pipe for fly waste, yarn waste and the like, which is extended through all the spinning units to discharge by suction the fly waste, yarn waste and the like generated at the draft part 7 and the air nozzle 8.

In the yarn spinning and transferring passage between the nip rollers 9 and the take-up part 11, a slub catcher 18 is provided for detecting the presence or absence of the spun yarn Y and detecting a slub (a thicker part of yarn). When a slub is detected, the spun yarn is cut at the slub part by a cutter not shown (this will be referred to the slub yarn breakage).

At a front end part of an upper part of the frame body 12, an obstacle signal indicating plate 19 is provided so as to be oscillatable about a shaft 20, with its lower end part extended into the internal space 14 of the frame body 12, and the lower end part is fitted with a spring 21 for urging the indicating plate 19 in the direction for protruding beyond a front surface part of the frame body 21. Numeral 22 denotes an electromagnet which attracts the obstacle signal indicating plate 19 and holds the plate 19 in a retracted condition; only when yarn breakage other than the slub yarn breakage (Such yarn breakage occurs, for instance, when the sliver runs out, and will be hereinafter referred to as the natural yarn breakage) is detected, the electromagnet 22 is deenergized to permit the indicating plate 19 to protrude, as indicated by imaginary lines.

The slub yarn breakage is detected through detection of the slub by the slub catcher 18 and detection of the absence of yarn immediately thereafter, while the natural yarn breakage is detected through only the detection of the absence of yarn by the slub catcher 18.

Further, in the internal space 14 of the frame body 12, a yarn breakage indicating piece 23 operated by a yarn absent signal from the slub catcher 18 in the cases of the slub yarn breakage and the natural yarn breakage is pivotally supported by a shaft 24, and it is fitted with a spring 25 for urgint it from an inoperative position indicated by solid lines to an operative position indicated by imaginary lines. Specifically, the yarn breakage indicating piece 23 is fitted with an iron piece 27 through a connecting rod 26, and an electromagnet 28 for attracting the iron piece 27 to hold the indicating piece 23 in the inoperative position is provided in the vicinity of the iron piece 27 so that the indicating piece 23 is displaced to the operative position when the electromagnet 28 is deenergized by the yarn absent signal from the slub catcher 18.

On the other hand, as shown in FIG. 2, the knotting truck 15 is provided with a suction pipe 31 for gripping an upper yarn on the spinning side by suction and leading it to a knotter 30, and a suction mouth 32 for gripping a lower yarn on the side of the package 10 by suction and leading it to the knotter 30. In this embodiment, the knotting truck 15 is illustrated as a truck provided with the knotter 30. However, the yarn joining operation can be performed by either device of a mechanical type and a pneumatic type. Accordingly, the joining device is not limited to so-called mechanical knotter. The suction pipe 31 and the suction mouth 32 are so disposed that they can be swivelled respectively. The upper yarn and the lower yarn are joined to each other by the knotter 30 fitted to the front surface part of the knotting truck 15. The knotting truck 15 is provided further with a natural yarn breakage detecting dog 33 engaged to a lower end part of the obstacle signal indicating plate 19 being in the protruded condition, and a yarn breakage detecting dog 34 engaged to the yarn breakage indicating piece 23 being in the operative condition. The dogs 33 and 34 are so disposed that they can be freely turned about shafts 25 and 36, respectively. In the vicinity of the dogs 33 and 34 are provided limit switches 37 and 38 for detecting the operations of the dogs 33 and 34, respectively. Even if a spinning unit in which natural yarn breakage has occurred is detected by the natural yarn breakage detecting dog 33, yarn joining cannot be performed in the case of the natural yarn breakage; therefore, the knotting truck 15 is not stopped at the position of the unit but passes by. Accordingly, where a spinning unit in which yarn breakage has occurred is detected through the yarn breakage detecting dog 34 during the movement of the knotting truck 15, the truck 15 is stopped at the position of the unit to join the yarns together only when the natural yarn breakage detecting dog 33 is inoperative.

The knotting truck 15 is provided with a tilting lever 39 by which a lower end part of the obstacle signal indicating plate 19 in the retracted condition is pushed in the acting direction of the force of the spring 21 to set the plate 19 into the protruded condition when starting the yarn joining operation, and a return lever 40 by which the lower end part of the indicating plate 19 in the protruded condition is pushed against the spring force to set the plate 19 into the retracted condition after completion of the joining operation, the levers 39 and 40 being so disposed that they can be turned about a common shaft 41. A sequence of joining operations inclusive of operations of the levers 39 and 40 is effected by a cam 42 provided in the knotting truck 15, once in one revolution of the cam 42.

Figure 4:
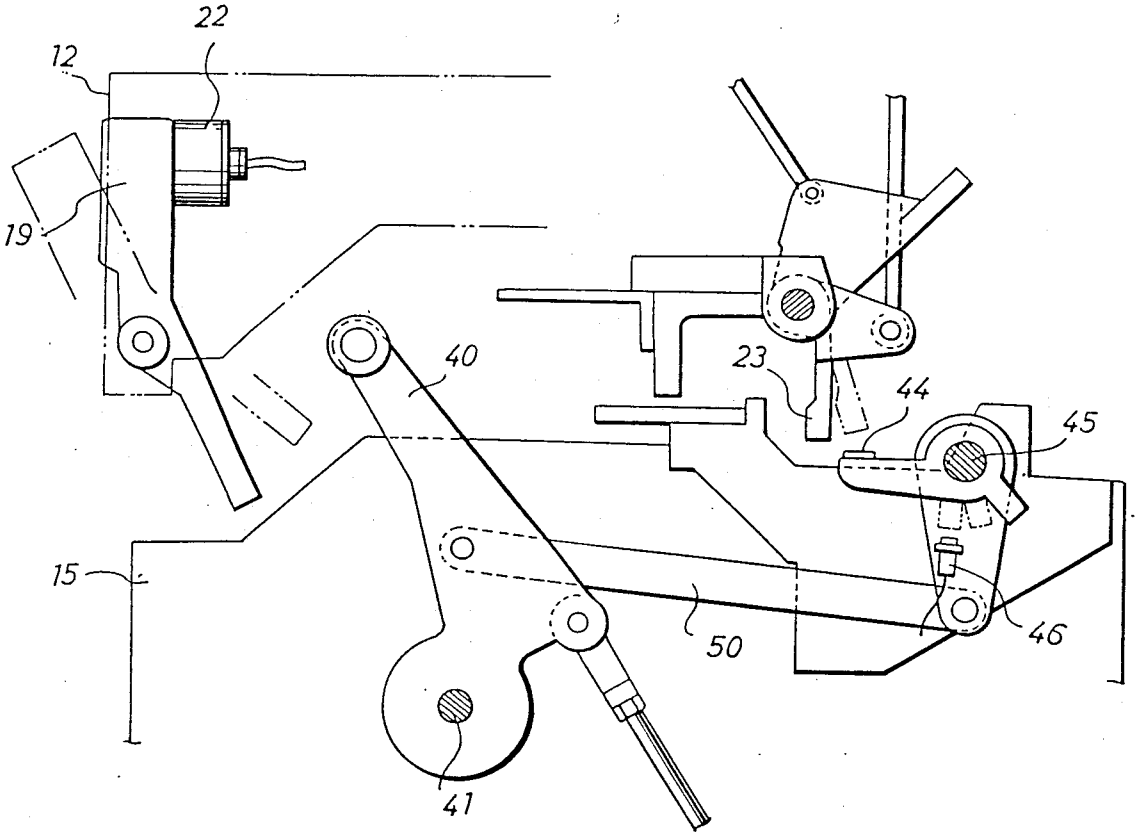
FIG. 4 is an enlarged schematic side view showing the same relationship.

In the above construction, to detect the percentage of successful joining on the knotting truck 15, the joining operation is first detected from the cam 42, and the success in joining is detected from the operations of the yarn breakage indicating piece 23 and the return lever 40. For detecting the joining operation from the cam 42, a joining operation detecting switch 43 as joining operation detecting means is provided in the vicinity of the cam 42, and it is turned ON once by one revolution of the cam 42 to generate a detection signal. On the other hand, for detecting the success in joining, as shown in FIG. 4, a swing arm 44 of which the turning is obstructed by engagement with the yarn breakage indicating piece 23 in the operative condition is provided through a shaft 45 in the vicinity of the yarn breakage detecting dog 34 on the knotting truck 15, and the other end of the swing arm 44 is connected to the return lever 40 through a link 50. In the vicinity of the swing arm 44 is provided a swing arm sensor 46 for detecting a complete turning without engaging with the yarn breakage indicating piece 23 of the swing arm 44, whereby a detection signal indicative of the success in joining is generated.

Figure 5:
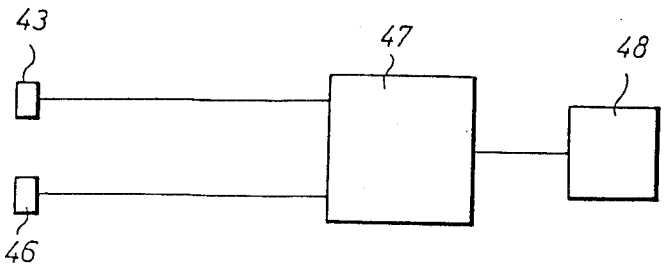
FIG. 5 is a basic block diagram of an essential part of the present device.

As shown in FIG. 5, the joining operation detecting switch 43 and the swing arm sensor 46 are electrically connected to an arithmetic part 47, which counts the number of times of joining operations, a, and the number of times of successful joining, b, based on the detection signals from the switch 43 and the sensor 46, and calculates the percentage of successful joining ($b/a \times 100\%$) from the counted values. For indicating the percentage of successful joining, a digital indicator panel 48 as means for indicating the percentage of successful joining is connected to an output part of the arithmetic part 47, and it is fitted to a front surface part of the blower box 2, as shown in FIG. 1.

Figure 3:
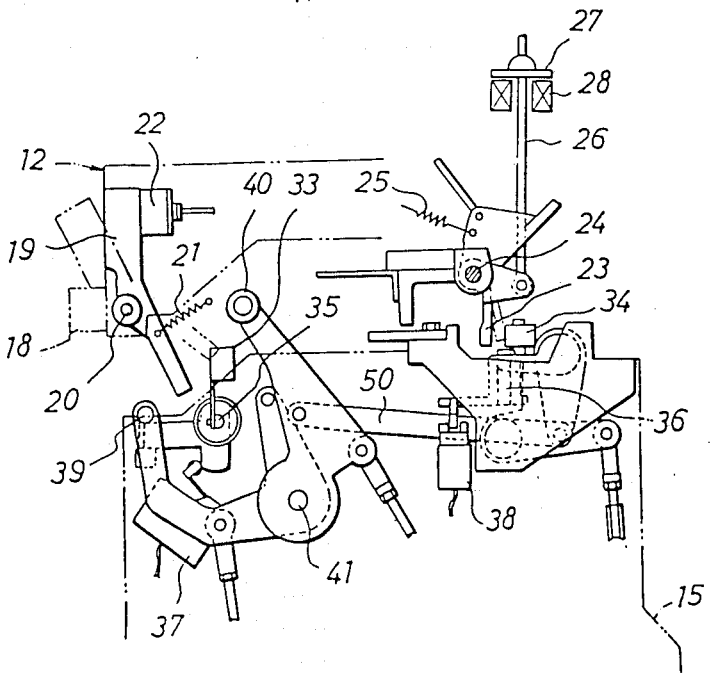
FIG. 3 is a side view illustrating the constructional relationship between a spinning unit and a knotting truck.

The actions will be described below.

Where the slub yarn breakage has occurred in a spinning unit, the yarn breakage indicating piece 23 is set into the operative condition, indicated by imaginary lines in FIG. 3, by the force of the spring 25 because of electromagnet 28 is deenergized based on the detection signal from the slub catcher 18, while the obstacle signal indicating plate 19 remains in the inoperative condition indicated by the solid lines. The knotting truck 15 being moved detects the spinning unit through engagement of the yarn breakage detecting dog 34 with the yarn breakage indicating piece 23 in the operative condition, is stopped at the position of the spinning unit, and starts the joining operation by driving the cam 42.

In starting the joining operation, first the tilting lever 39 operates to tilt down the obstacle signal indicating plate 19 being in the inoperative condition, and the return lever 40 operates to return the plate 19 on completion of the joining operation. At this time, the operation of the return lever 40 is transmitted to the swing arm 44 through the link 50, and the arm 44 tends to turn about the shaft 45 as a fulcrum. Where the joined yarn condition is detected through the slub catcher 18 and the joining is successful, the electromagnet 28 is excited, and the yarn breakage indicating piece 23 comes into the inoperative condition indicated by solid lines in FIG. 4. Therefore, the swing arm 44 is completely turned without engaging with the yarn breakage indicating piece 23, so that the obstacle signal indicating plate 19 is returned to the inoperative condition through the return lever 40, and the success in yarn joining is detected by the swing arm sensor 46, upon which the knotting truck 15 is restarted moving. Based on the detection signals and the detection signals from the joining operation detecting switch 43 for detecting the operation of the cam 42, the arithmetic part 47 counts the number of times of successful joining and the number of times of joining operations. Where the joining is unsuccessful, the yarn breakage indicating piece 23 remains in the operative condition indicated by the imaginary lines, so that the swing arm 44 engages with the indicating piece 23 and is thereby inhibited from turning. As a result, successful joining is not detected, and the return lever 40 is prevented from turning, so that the obstacle signal indicating plate 19 is not returned into the inoperative condition. Namely, the mechanism is returned to the condition upon detection of the spinning unit in which the yarn breakage has occurred, and, accordingly, the cam 42 is again rotated to repeat the yarn joining operation. Thus, where the joining is unsuccessful, only the number of times of joining operations is counted.

Incidentally, the number of repetition of joining in a given spinning unit is preset to be 2 to 3, and where joining is not successful even after repeating the yarn joining operation the preset number of times, the knotting truck 15 is restarted moving with the obstacle signal indicating plate 19 left protruded.

The arithmetic part 47 calculates the percentage of successful joining from the counted values of the number of times of yarn joining operations and the number of times of successful joining, and sends an output signal to the digital indicator panel 48, which indicates the percentage of successful joining. Accordingly, by looking at the indicator panel 48, it is possible to easily grasp the operating efficiency of the knotting truck 15 and to easily find a defective knotting truck low in the percentage of successful joining, so that it is possible to swiftly cope with the defective knotting truck, and the operating efficiency of the spinning machine is remarkably enhanced.

Although the success in joining is detected indirectly through the swing arm sensor 44 in the working example, the success may be detected directly from the slub catcher 18.

Figure 6:
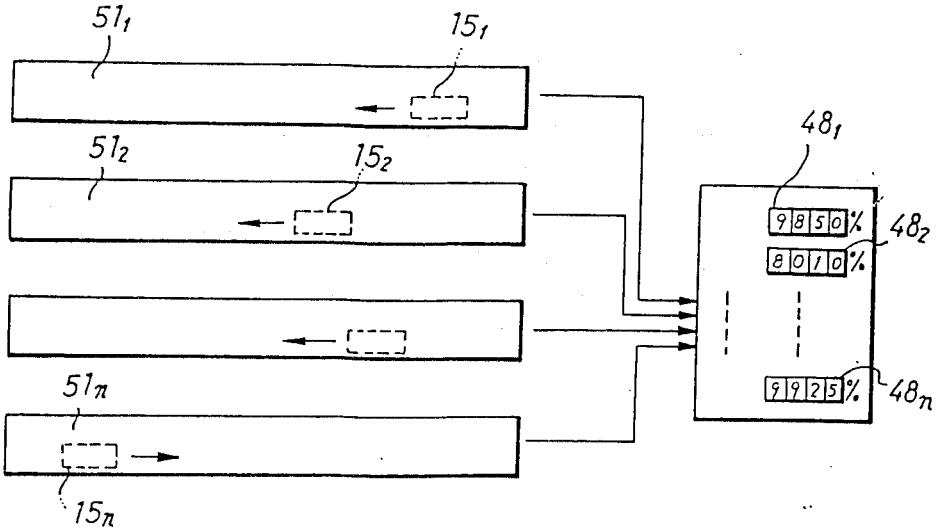
FIG. 6 is a schematic constructional view of a modified example.

In addition, in a spinning mill provided with a plurality of spinning machines $\mathbf{51}_1$ to $\mathbf{51}_n$ as shown in FIG. 6, the operations can be easily controlled by providing at one place the indicating parts $\mathbf{48}_1$ to $\mathbf{48}_n$ for indicating the percentages of successful joining in the knotting trucks $\mathbf{15}_1$ to $\mathbf{15}_n$. It goes without saying that an indicator panel 48 is fitted to each knotting truck 15.

In short, the present device has the following effects.

(1) Since the percentage of successful joining can be indicated, it is possible to easily grasp the operating conditions of the knotting trucks and to swiftly cope with any defective knotting truck, whereby the operating efficiency of the spinning machine can be remarkably enhanced.

(2) Since there is no need for drastic modifications other than the addition of the joining operation detecting means to the knotting truck, the preset device can be easily applied to existing installations.

What is claimed is:

1. A spinning machine comprising a plurality of spinning units disposed adjacent to each other and having yarn-detecting means in respective yarn spinning and yarn running passages, a knotting truck disposed to be movable along said spinning units so as to detect the spinning unit in which yarn breakage has occurred on the basis of a yarn absent signal from said yarn-detecting means and to perform yarn joining, means for detecting the joining operation of said knotting truck, an arithmetic part for counting the number of times of joining operation based on detection signals from said yarn joining operation detecting means and counting the number of times of successful joining based on yarn present signals from said yarn-detecting means to calculate the percentage of successful joining from the counted values, means for indicating the percentage of successful joining according to an output signal from said arithmetic part, said yarn-detecting means being a slub catcher, means for detecting the spinning unit in which yarn breakage has occurred comprising an obstacle signal indicating plate provided on a frame body of the spinning unit so as to be oscillatable, said obstacle signal indicating plate protruding when yarn breakage other than the slub yarn breakage is detected by the slub catcher, and yarn breakage indicating piece provided in the internal space of the frame body of the spinning unit and operated by a yarn absent signal from the slub catcher.

2. The spinning machine as claimed in claim 1, wherein said knotting truck provides a first natural yarn breakage detecting dog being able to engage to the obstacle signal indicating plate and a second yarn breakage detecting dog being able to engage with the yarn breakage indicating piece, whereby said knotting truck is stopped at the position of the unit to join the yarns together only when the second yarn breakage detecting dog is engaged with the yarn breakage indicating piece and is operative.

3. The spinning machine as claimed in claim 2, wherein said knotting truck further provides a first lever for setting the obstacle signal indicating plate into the protruded condition when starting the yarn joining operation, and a second return lever for setting the obstacle signal indicating plate into the retracted condition after completion of the yarn joining operation, and a cam for effecting a sequence of joining operation inclusive of operation of the first and second levers.

4. The spinning machine as claimed in claim 3, wherein the success in joining is detected from the operations of the yarn breakage indicating piece and the second return lever, and a swing arm with which the yarn breakage indicating piece may be engaged and a swing arm sensor for generating a detection signal indicative of the success in joining are provided on the knotting truck.

* * * * *